United States Patent [19]

Sugimoto

[11] 4,217,768

[45] Aug. 19, 1980

[54] DYEING APPARATUS

[75] Inventor: Isao Sugimoto, Aichi, Japan

[73] Assignees: Nippon Dyeing Machine Mfg. Co., Ltd., Ama; Yoshida Kogyo K.K., Tokyo, both of Japan

[21] Appl. No.: 957,181

[22] Filed: Nov. 2, 1978

[30] Foreign Application Priority Data

Nov. 14, 1977 [JP] Japan ..... 52-135672

[51] Int. Cl.[3] ..... D06B 5/18; D06B 21/02

[52] U.S. Cl. ..... 68/20; 68/189

[58] Field of Search ..... 68/150, 189, 198, 20, 68/15

[56] References Cited

U.S. PATENT DOCUMENTS

| | | | |
|---|---|---|---|
| 1,174,662 | 3/1916 | Brandwood et al. | 68/189 |
| 1,280,188 | 10/1918 | Dudley | 68/150 |
| 3,685,324 | 8/1972 | Vorderbruegge et al. | 68/150 |

FOREIGN PATENT DOCUMENTS

| | | | |
|---|---|---|---|
| 2525871 | 12/1976 | Fed. Rep. of Germany | 68/189 |
| 2258902 | 8/1975 | France | 68/189 |

*Primary Examiner*—Philip R. Coe

*Attorney, Agent, or Firm*—Bucknam and Archer

[57] ABSTRACT

A dyeing apparatus is disclosed, which comprises a vessel and a perforated cylinder or beam concentrical thereto, the cylinder having a material wound thereon which is to be dyed. The apparatus includes means for isolating idle space within the vessel from the dye liquid circulating region and means for supplying compressed air to the circulating region to dewater the dyed material upon completion of a cycle of dyeing operation. A stream of compressed air permeates the wet material and takes the moisture away as an entrainment. The same apparatus can perform both the dyeing and the drying operation.

4 Claims, 3 Drawing Figures

DYEING APPARATUS

BACKGROUND OF THE INVENTION

1. Field of the Invention:

This invention relates to improvements in and relating to a dyeing apparatus, more particularly to such an apparatus which is equipped with a perforated cylinder or beam for winding thereon a material to be dyed and with means for dewatering or demoisturing the dyed material.

2. Prior Art:

Conventional dyeing apparatus of the type described generally comprise a dyeing vessel connected to a dye circulating system including a motor, a pump, conduit piping and a heat-exchanger, the arrangement being that dye liquid is supplied to and withdrawn from the vessel and circulated back to the vessel, in which instance the vessel is required to be filled up so as to ensure complete soaking of the material within the vessel. With such conventional apparatus, increased amounts of dye liquid have been required to carry out the beam dyeing operation; usually about from 1:15 to 1:25 bath ratios of material to dye liquid being used. Consequently, it has been necessary to increase the size or capacity of the motors, pumps, heat-exchangers and other equipment associated with the dyeing vessel, and furthermore to treat large quantities of waste liquid.

SUMMARY OF THE INVENTION

Whereas, the present invention seeks to provide an improved beam-dyeing apparatus which can accomplish the dyeing operation efficiently and completely with reduced equipment capacity and hence, minimum consumption of power and dye liquid (dye-stuff and assistants), and which can further effect the dehydration of dyed material at maximum speed.

This and other objects and features of the invention will be better understood from reading the following detailed description taken with reference to the accompanying drawings which illustrate by way of example a preferred embodiment which the invention may assume in practice.

BRIEF DESCRIPTION OF THE DRAWINGS

In the drawings in which like reference characters refer to like and corresponding parts throughout the several views.

DESCRIPTION OF THE PREFERRED EMBODIMENT

Figure 1:
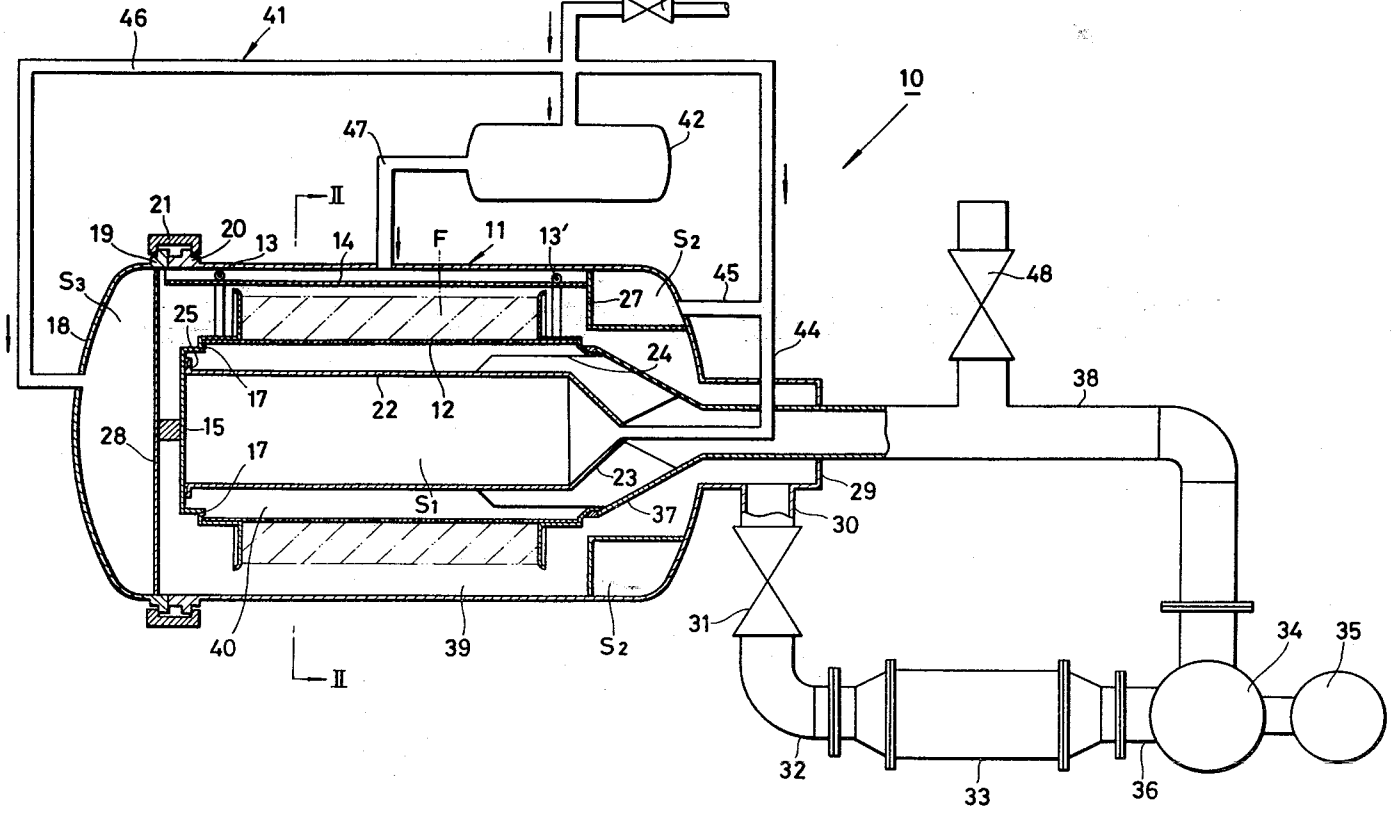
FIG. 1 is a longitudinal cross-sectional, partly schematic, view of a beam dyeing apparatus provided in accordance with the invention.

Referring now to the drawings and FIG. 1 in particular, there is shown a beam-dyeing apparatus of the invention generally designated at 10, which apparatus comprises a horizontally mounted vessel 11 which is generally circular in its cross section. A perforated cylinder 12, commonly known as a beam, is mounted concentrically within the vessel 11. The beam 12 has a pair of rollers 13,13' at its opposite ends which are movably mounted on a rail 14 secured to and extending longitudinally of the vessel 11. The front end of the beam 12 upon being inserted into the vessel 11, is closed by a lid 15 which has a bevelled portion 16 (FIG. 3) engageable with a taper flange 17. A plurality of these taper flanges 17 are provided adjacent each end of the beam 12 to confine and hold a fabric F wound around the beam 12 which is to be dyed.

The lid 15 is covered by a removable cap 18 which has a rim 19 for sealing engagement with a similar rim 20 formed on the vessel 11. The two rims 19,20 are clamped together by a clamping ring 21.

Figure 3:
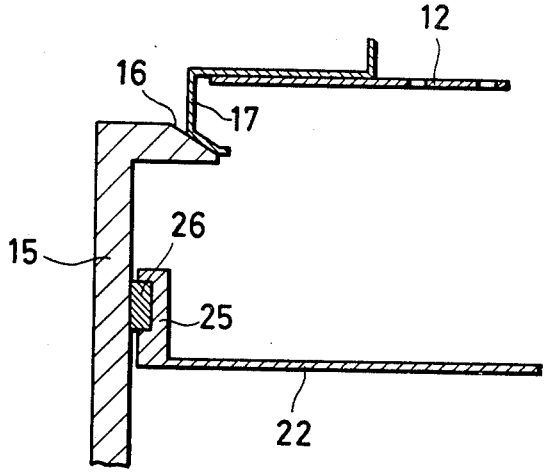
FIG. 3 is a sectional view of a portion of the apparatus shown in FIG. 1.

A dummy non-perforated cylinder 22 is mounted concentrically within the perforated cylinder or beam 12, and has a conically shaped, closed rear end 23 which is supported in place by arms 24 extending suitably from a rigid frame member not shown. The open front end of the dummy cylinder 22 is closed by the lid 15, as a recessed rim 25 formed on the cylinder 22 is fitted with a projection 26 on the lid 15, as shown in FIG. 3. The dummy cylinder 22 is provided primarily for the purpose of minimizing idle space $S_1$ within the beam 12 and hence economizing the use of operating dye liquid. To achieve the same purpose, a partition member 27 is provided to isolate idle space $S_2$ at the rear end portion of the vessel 11 from the liquid circulating areas of the vessel, the member 27 extending inwardly circumferentially of the wall of the vessel 11.

Another partition member 28 is provided to isolate idle space $S_3$ defined by the cap 18 from the liquid circulating areas of the vessel 11, the member 28 being secured circumferentially to the rim 19 of the cap 18.

Figure 2:
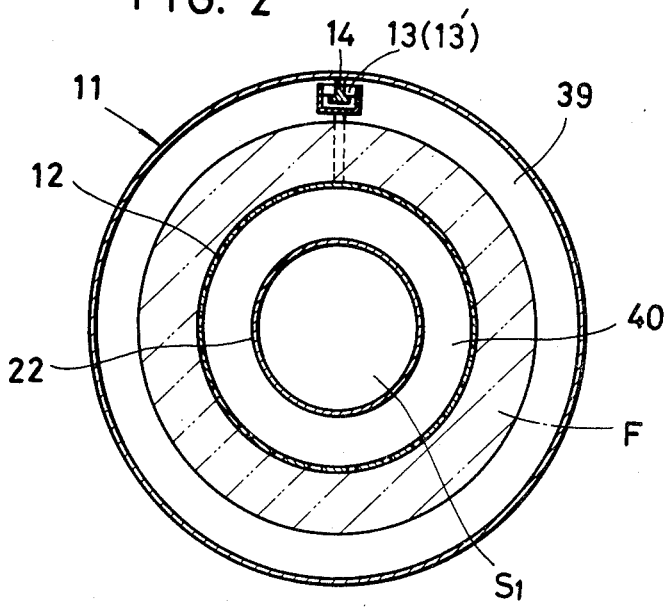
FIG. 2 is a transverse cross-sectional view taken on the line II—II of FIG. 1.

As better shown in FIG. 2, there are formed a first circumferential chamber 39, hereinafter referred to as a circulation chamber, between the inner wall of the vessel 11 and the outer wall of the beam 12, and a second circumferential chamber 40, hereinafter referred to as a treatment chamber, between the inner wall of the beam 12 and the outer wall of the dummy cylinder 22.

The vessel 11 is provided at its rear end with a rearwardly projecting neck 29, to the bottom of which is connected a conduit 30 for withdrawing the dye liquid from the vessel 11. The conduit 30 is connected via valve 31 to conduit 32 which is in turn connected to a heat-exchanger 33 adapted to maintain the dye liquid at a predetermined temperature during a cycle of dyeing operation. A pump 34 driven by a motor 35 is connected at its suction side to the heat-exchanger 33 via conduit 36 and at its discharge side to a flared connector 37 via conduit 38, the flared connector 37 having its flared end substantially coextensive in diameter with the beam 12 to effect uniform distribution of dye liquid through the treatment chamber 40.

In the operation of the dyeing apparatus 10 of the invention, the dye liquid is supplied by the pump 34 through the discharge conduit 38 and through the flared connector 37 whereupon the liquid is distributed uniformly through the treatment chamber 40. The liquid is forced radially outwardly through the perforated beam 12 and into the layer of fabric F wound thereon and after soaking the fabric layer F to depth, is allowed to overflow into the circulation chamber 39. The dye liquid is withdrawn via conduits 30 and 32 past the heat-exchanger 33 and conduit 36 back to the pump 34. The dye liquid is thus recirculated through the dyeing system to repeat the operation. Upon completion of the cycle of dyeing operation, the fabric F is dewatered or demoistured efficiently as desired by the same equipment, for which purpose there is provided means generally designated at 41 for storing and supplying compressed air to the interior of the vessel 11. The means 41 comprises an air tank 42 installed outside of the vessel 11 for storing compressed air supplied from a suitable source thereof (not shown) via valve 43.

To the tank 42 are connected a first piping 44 leading to and communicating with the space $S_1$ inside of the dummy cylinder 22, a second piping 45 leading to and communicating with the space $S_2$ at the rear end of the vessel 11 and a third piping 46 leading to and communicating with the space $S_3$ at the front end of the vessel 11, the arrangement being that a closed circuit is formed for normally maintaining an equalized air pressure between the idle spaces $S_1$, $S_2$, $S_3$ bounded by dummy cylinder 22 and partition members 27, 28, and the adjoining spaces of the circulation chamber 39 and the treatment chamber 40. The dummy cylinder 22, the partition member 27 and the partition member 28 can be considered as idle space isolating means as the idle spaces which they bound serve as a reservoir for holding compressed air within the vessel 11.

The advantage accruing from this arrangement is that the idle spaces $S_1$, $S_2$ and $S_3$ as well as the tank 42 are effectively utilized to hold an inventory of compressed air required to dewater or demoisture the fabric F which has been soaked wet with dye liquid. An inlet piping 47 is connected to the tank 42 communicates with the treatment chamber 40 for introducing the air into the vessel 11. Another advantage of the apparatus according to the invention is that when treating the fabric F under elevated temperature and pressure conditions, any excess of dye liquid resulting therefrom can be taken through the piping 47 into and stored in the tank 42. Because of the equalized pressure communication between the vessel 11 and the tank 42, such excessive dye liquid flows spontaneously into the tank 42 via the piping 47.

When setting the apparatus 10 in a dewatering mode of operation, the valve 31 is closed and the air supply valve 43 is opened to supply a stream of compressed air through the inlet piping 47 into the vessel 11, whereupon the pressure in the vessel 11 is increased. As this pressure reaches a predetermined point, a vent valve 48 in the conduit 38 is opened rapidly so that the compressed air passes through the layer of fabric F to dewater the same as the liquid is entrained with the stream of compressed air and carried out through the vent valve 48 into the atmosphere. This operation may be repeated as many times as is required to obtain a maximum dewatering effect.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In a dyeing apparatus including a cylindrical vessel of generally circular cross-section extending longitudinally along a generally horizontal axis, said vessel having an outer wall; a perforated hollow beam supported within said vessel and extending longitudinally along said axis, said beam being capable of winding thereon material to be dyed and allowing dye liquid through its perforations to flow into and through the material; partition means defining dye liquid exclusion spaces within said vessel and defining with said vessel a flow passage for the dye liquid, said partition means including a partition spaced-apart in relation to said outer wall of the vessel to define with said outer wall a circumferentially extending circulation chamber and to define a circumferentially extending treatment chamber adjoining said circulation chamber, said hollow beam having a perforated member defining a boundary between said treatment chamber and circulation chamber, the material to be dyed being wound upon said perforated member so as to be positioned in said circulation chamber, the improvement which comprises means for storing and supplying compressed air to said circulation chamber, said air storing and supplying means being positioned outside the vessel and communicating with said circulation chamber to dehydrate dyed material by flow therethrough into the treatment chamber, and communicating with said dye liquid exclusion spaces, to utilize said spaces as a reservoir for holding compressed air used to dehydrate dyed material.

2. A dyeing apparatus according to claim 1, wherein said air storing and supplying means includes an air storage tank and a conduit connected thereto and communicating with said circulation chamber.

3. A dyeing apparatus according to claim 1, wherein said partition means includes a non-perforated cylinder supported within said beam and extending longitudinally along said axis, and a plurality of partition members each defining an end boundary of said circulation chamber within the vessel.

4. In a dyeing apparatus having a containment vessel in which material to be dyed is supported for contact with a dye liquid introduced into the vessel, and partition means defines within said vessel at least one enclosed hollow space, said partition means excluding the dye liquid from the volume of said hollow space to reduce by a corresponding volume the amount of dye liquid required to fill the remaining volume of the vessel, the improvement which comprises conduit means flow connected with said vessel and with a source of compressed air to introduce into said vessel compressed air to contact said material after dyeing thereof to drive off liquid therefrom, said conduit means communicating with said hollow space to introduce therein compressed air for storage thereby and subsequent release therefrom to drive off the dye liquid from the material, said partition means being disposed such that the pressures resulting from compressed air acting to drive off dye liquid, and from compressed air stored in said hollow space, are equalized.

* * * * *